United States Patent [19]

Katahira et al.

[11] 4,175,386

[45] Nov. 27, 1979

[54] EXHAUST GAS PURIFICATION APPARATUS FOR AN INTERNAL COMBUSTION ENGINE

[75] Inventors: Eturou Katahira; Shunzo Yamaguchi, both of Okazaki; Masashi Kida, Nishio; Yasuhiko Ishida, Susono, all of Japan

[73] Assignees: Nippon Soken, Inc., Nishio; Toyota Jidosha Kogyo Kabushiki Kaisha, Toyota, both of Japan

[21] Appl. No.: 772,277

[22] Filed: Feb. 25, 1977

[30] Foreign Application Priority Data

| | | | |
|---|---|---|---|
| Mar. 8, 1976 | [JP] | Japan | 51-24907 |
| Apr. 13, 1976 | [JP] | Japan | 51-42146 |
| Apr. 14, 1976 | [JP] | Japan | 51-42695 |

[51] Int. Cl.[2] ..... F01N 3/10

[52] U.S. Cl. ..... 60/276; 60/289; 60/290

[58] Field of Search ..... 60/276, 289, 290

[56] References Cited

U.S. PATENT DOCUMENTS

| | | | |
|---|---|---|---|
| 3,911,674 | 10/1975 | Goto | 60/290 |
| 3,931,710 | 1/1976 | Hartel | 60/290 |
| 3,962,867 | 6/1976 | Ikeura | 60/290 |
| 4,007,718 | 2/1977 | Laprade | 60/276 |
| 4,020,813 | 5/1977 | Hattori | 123/124 R |

*Primary Examiner*—Douglas Hart

*Attorney, Agent, or Firm*—Cushman, Darby & Cushman

[57] ABSTRACT

A secondary air supply pipe line is opened in the exhaust pipe of an internal combustion engine on the upstream side of an exhaust gas reactor which is mounted in the exhaust pipe, and an air-fuel ratio sensor for detecting the air-fuel ratio of exhaust gases is mounted in the exhaust pipe on the downstream side of the portion where the secondary air supply pipe line is open. An air flow control valve for on-off controlling the flow of air in the secondary air supply pipe line is operated in accordance with the output signal of the air-fuel ratio sensor. When the air-fuel ratio of the exhaust gases is low the secondary air supply pipe line is fully opened by the air flow control valve in response to the output signal of the air-fuel ratio sensor, whereas when the air-fuel ratio of the exhaust gases is high the secondary air supply pipe line is fully closed by the air flow control valve in response to the output signal of the air-fuel ratio sensor, whereby maintaining the air-fuel ratio of exhaust gases supplied to the exhaust gas reactor at a predetermined value.

7 Claims, 21 Drawing Figures

EXHAUST GAS PURIFICATION APPARATUS FOR AN INTERNAL COMBUSTION ENGINE

FIELD OF THE INVENTION

The present invention relates to exhaust gas purification apparatus for internal combustion engines and more particularly the invention relates to an exhaust gas purification apparatus including an exhaust gas reactor, secondary air supply means, and secondary air flow control means which utilizes an air-fuel ratio sensor to control the air-fuel ratio of exhaust gases in such a manner that the optimum purification condition is ensured for the exhaust gas reactor.

DESCRIPTION OF THE PRIOR ART

Figure 1:
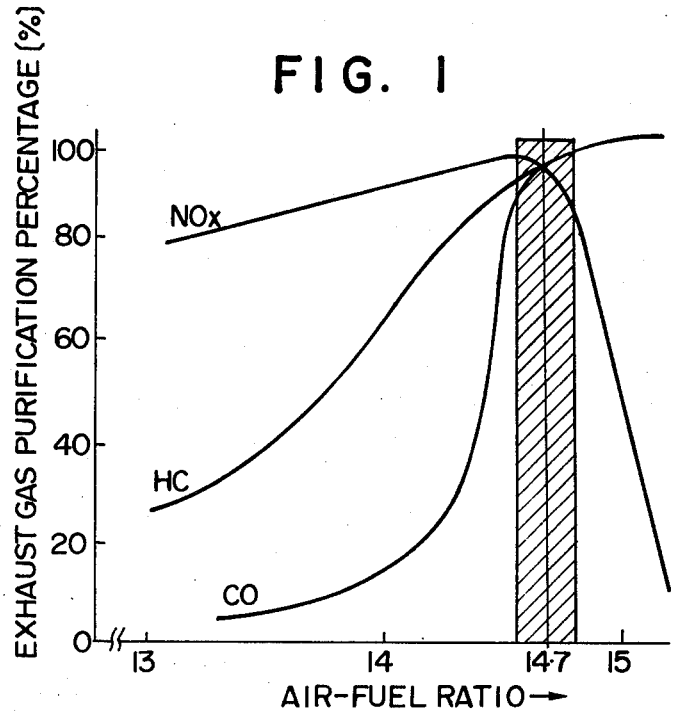
FIG. 1 is a purification efficiency diagram of a three-way catalyst.

Generally, a so-called three-way catalyst which utilizes the same catalytic bed as a medium for oxidizing the carbon monoxide (CO) and hydrocarbons (HC) and reducing the nitrogen oxides ($NO_x$) in exhaust gases to convert these harmful exhaust gas constituents into harmless elements, has a purification efficiency characteristic as shown in FIG. 1 in relation to the air-fuel ratio of exhaust gases. Consequently, to ensure the operation of such three-way catalyst in a high purification percentage range, the air-fuel ratio of exhaust gases must be maintained within the hatched area shown in FIG. 1. Also, where an exhaust gas reactor is selected from any of catalysts including the three-way catalyst, after-burners, etc., such exhaust gas reactor has its own optimum range of air-fuel ratios. To date, however, it has been extremely difficult for the conventional exhaust gas purification apparatus of the type employing such exhaust gas reactor to limit the air-fuel ratio of exhaust gases within the hatched area shown in FIG. 1 throughout the range of the operating conditions of an internal combustion engine and consequently it has been impossible for the conventional exhaust gas purification apparatus to allow full display of the purification capability of their exhaust gas reactors.

SUMMARY OF THE INVENTION

With a view to overcoming the foregoing difficulty, it is the object of this invention to provide an improved exhaust gas purification apparatus of the type having secondary air supply means, wherein an air-fuel ratio sensor senses the oxygen content of exhaust gases which is varied in accordance with the operating conditions of an internal combustion engine and the output characteristic of the air-fuel ratio sensor is utilized so as to compensate the amount of secondary air supplied by the secondary air supply means, whereby if, for example, a three-way catalyst is used, the air-fuel ratio of exhaust gases supplied to the three-way catalyst is maintained within the hatched range shown in FIG. 1, thereby allowing the three-way catalyst to always operate in a high purification percentage area.

DESCRIPTION OF THE PREFERRED EMBODIMENTS

The present invention will now be described in greater detail with reference to its embodiments illustrated in the accompanying drawings.

Figure 2:
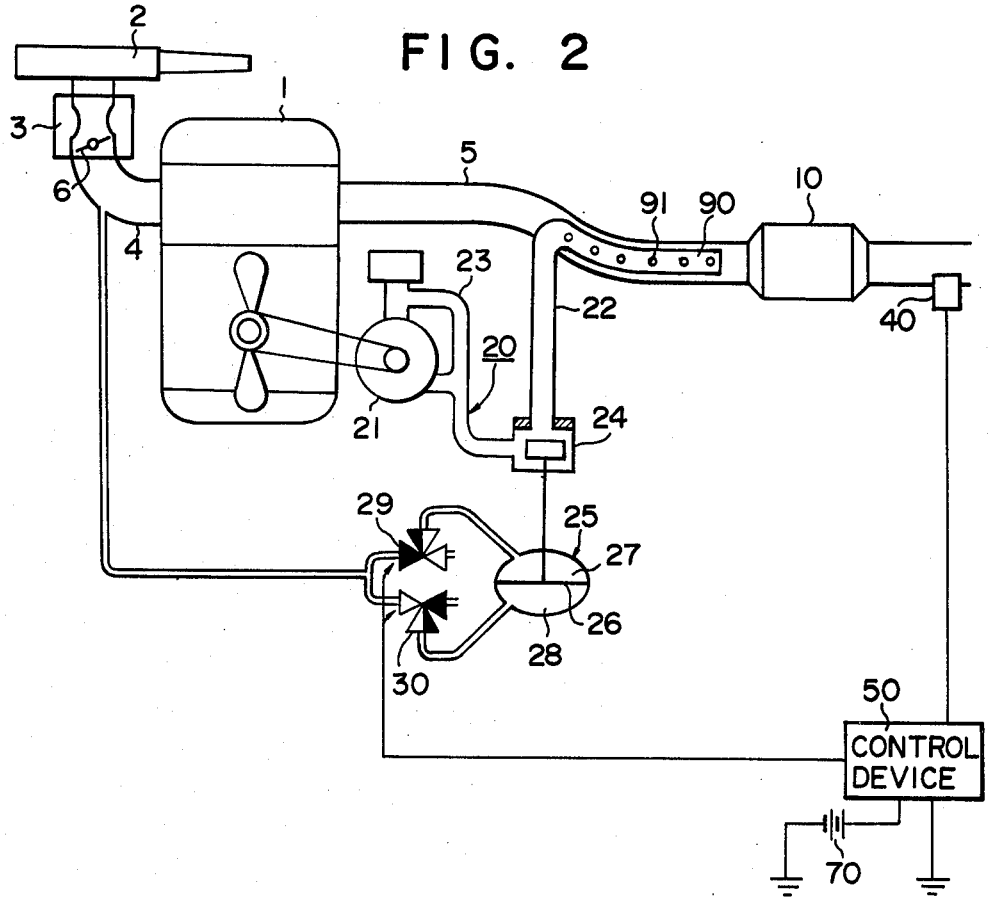
FIG. 2 is a schematic diagram showing an embodiment of an exhaust gas purification apparatus according to the present invention.

Referring first to FIG. 2 showing the first embodiment, numeral 1 designates an internal combustion engine, 2 an air cleaner, 3 a carburetor, 4 an intake pipe, 5 an exhaust pipe. As is well known, the purpose of the carburetor 3 is to meter fuel (here the carburetor 3 has been adjusted to provide a mixture which is slightly rich in fuel as compared with the ordinary air-fuel mixture ratio), namely, the ordinary main air which is controlled in amount by a throttle valve 6, is supplied from the air cleaner 2, mixed with the corresponding amount of fuel in the carburetor 3 and fed to the engine 1 through the intake pipe 4. After the mixture has been burned in the engine 1, the resulting exhaust gases are discharged to the atmosphere through the exhaust pipe 5.

Numeral 10 designates an exhaust gas reactor mounted in the exhaust pipe 5, which comprises a three-way catalyst in this embodiment. As is well known, the three-way catalyst facilitates the oxidation of CO and HC and reduction of $NO_x$ in the exhaust gases admitted into the three-way catalyst and it converts these harmful constituents into harmless constituents with the purification efficiency shown in FIG. 1. Particularly, if the air-fuel ratio is at around the stoichiometric air-fuel ratio (i.e., about 14.7:1), all of the CO, HC and $NO_x$ can be purified with a high degree of purification efficiency.

Numeral 20 designates secondary air supply means including an air pump 21 adapted to be driven by the engine 1 and a supply pipe line 22 for conveying air delivered under pressure by the air pump 21, and the supply pipe line 22 is opened in the exhaust pipe 5 upstream of the exhaust gas reactor 10 to supply secondary air to the exhaust gases in the exhaust pipe 5 upstream of the exhaust gas reactor 10. The supply pipe line 22 includes a relief passage 23 which is communicated with the intake side of the air pump 21 and a first air flow control valve 24 disposed downstream of the relief passage 23 so as to be fully opened and closed to control the amount of air delivered by the air pump 21 into the exhaust pipe 5. The excess air is returned to the intake side of the air pump 21 through the relief passage 23.

The control valve 24 is opened and closed intermittently by a diaphragm unit 25 which is connected to the former. The diaphragm unit 25 includes two pressure chambers 27 and 28 which are defined by a diaphragm 26. The pressure chamber 27 is connected to a first electromagnetic three-way valve 29 and the pressure chamber 28 is connected to a second electromagnetic three-way valve 30. When atmospheric pressure is introduced into the pressure chamber 27 through the first electromagnetic three-way valve 29, the negative pressure in the intake pipe 4 is introduced into the pressure chamber 28 through the second electromagnetic three-way valve 30. When atmospheric pressure is introduced into the pressure chamber 28 through the second electromagnetic three-way valve 30, the negative pressure in the intake pipe 4 is introduced into the pressure chamber 27 through the first electromagnetic three-way valve 29. Thus, the control valve 24 is opened and closed intermittently in accordance with the pressure difference applied to the unit 25. The diaphragm unit 25 and the first and second electromagnetic three-way valves 29 and 30 constitute first actuating means for the control means 24.

Figure 3:
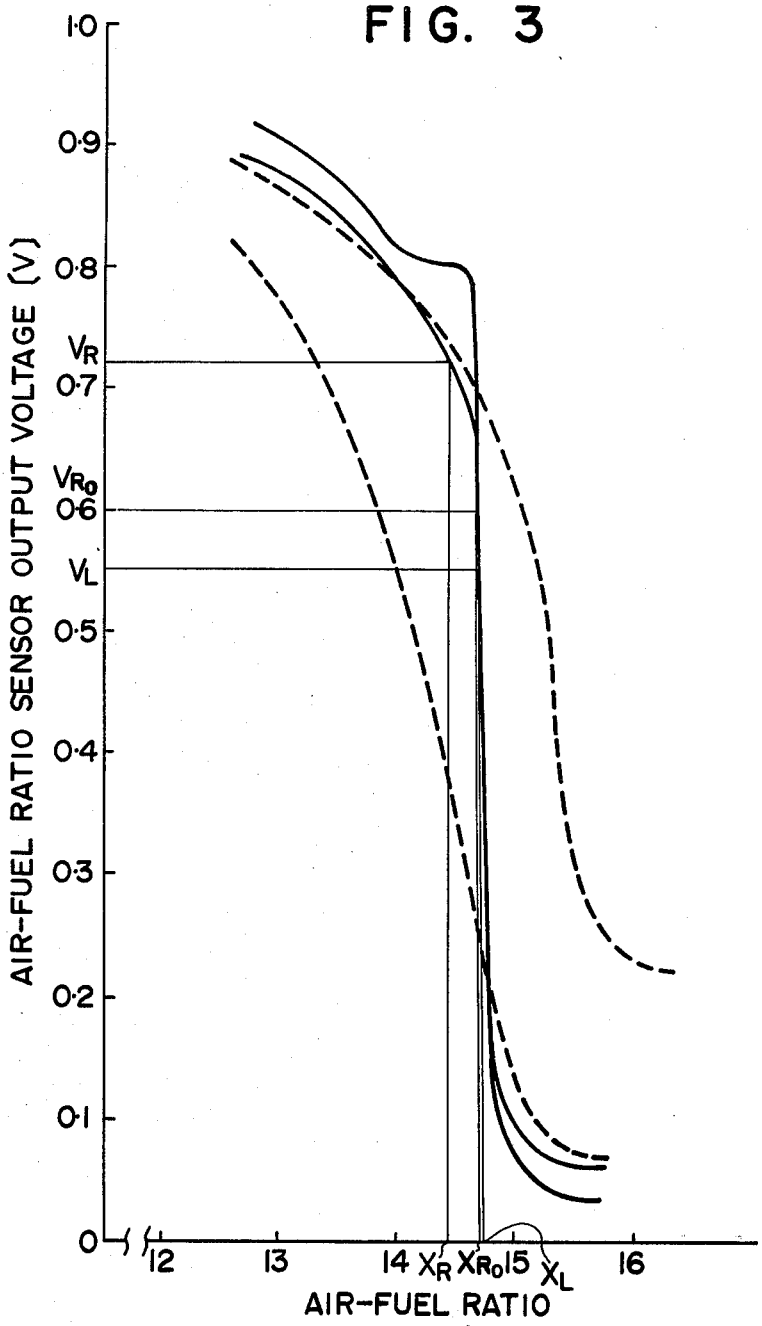
FIG. 3 is a characteristic diagram of the air-fuel ratio sensor used in the embodiment shown in FIG. 2.

Numeral 40 designates an air-fuel ratio sensor of a known type, which detects the air-fuel ratio of exhaust gases by means of the oxygen content thereof to produce an output corresponding to the air-fuel ratio in accordance with the characteristic shown by the solid lines in FIG. 3. In fact, this characteristic is represented by the area defined by the two solid lines.

The definition of "air-fuel ratio of exhaust gases" used hereinafter is as follows:

$$\text{air-fuel ratio of exhaust gases} = \frac{\text{amount of air supplied to the engine} + \text{amount of air supplied to the exhaust pipe}}{\text{amount of fuel supplied to the engine}}$$

While this air-fuel ratio sensor 40 may be basically disposed in the exhaust pipe 5 downstream of the portion where the supply pipe line 22 is open so that the air-fuel ratio sensor 40 is exposed to the exhaust gases which have been mixed with secondary air by the secondary air supply means 20, the air-fuel ratio sensor 40 should more preferably be disposed in the exhaust pipe 5 downstream of the exhaust gas reactor 10. The reason is that by disposing the air-fuel ratio sensor in such position, firstly it is possible to stabilize the operating temperature of the air-fuel ratio sensor 40. Because, owing to the three-way catalyst being activated, the temperature at a position just behind the three-way catalyst is stable against changes in the operating conditions of the engine 1. Secondly, an improved output characteristic is ensured for the air-fuel ratio sensor 40. For example, if the air-fuel ratio sensor 40 is disposed in front of the three-way catalyst, when the air-fuel ratio of the mixture supplied to the engine 1 is small (e.g., the air/-fuel $\leqq$ 13.0:1), the output characteristic of the air-fuel ratio sensor 40 is deviated from its inherent Z form as shown by the dotted lines in FIG. 3 and it tends to rise more slowly. On the contrary, when the air-fuel ratio sensor 40 is disposed just behind the three-way catalyst, a stable Z-type output characteristic is obtained for the air-fuel ratio sensor 40 irrespective of the air-fuel ratio of mixtures supplied to the engine 1.

Numeral 50 designates a control device comprising electric circuits and designed to receive as its input the output of the air-fuel ratio sensor 40 and operate on this input to simultaneously operate the first and second electromagnetic three-way valves 29 and 30. Preferably, the first electromagnetic three-way valve 29 is designed so that it normally introduces atmosphere into the one pressure chamber 27 of the diaphragm unit 25, whereas it introduces the intake vacuum into the pressure chamber 27 when it is energized. Contrary, the second electromagnetic three-way valve 30 normally introduces the intake vacuum into the other pressure chamber 28, whereas upon energization it introduces atmosphere into the pressure chamber 28.

Figure 4:
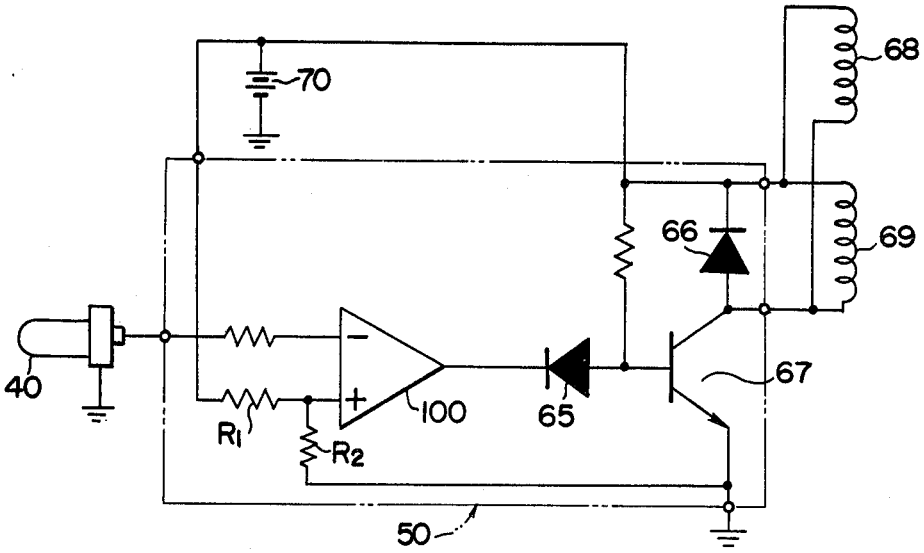
FIG. 4 is a circuit diagram of the control device used in the embodiment shown in FIG. 2.

FIG. 4 shows an electric wiring diagram for the control device 50. In this wiring diagram, numeral 100 designates a comparator for comparing the output voltage of the air-fuel ratio sensor 40 with a reference voltage $V_{Ro}$ which is preset by resistors $R_1$ and $R_2$ (the reference voltage $V_{Ro}$ is about 0.6 V in this embodiment). Numerals 65 and 66 designate diodes, 67 a transistor, 68 and 69 solenoids for the first and second electromagnetic three-way valves 29 and 30, 70 a power source.

Assuming now that the air-fuel ratio of the exhaust gases reaching the air-fuel ratio sensor 40 is smaller than a desired air-fuel ratio $X_{Ro}$ shown in FIG. 3 (the ratio is about 14.7:1 in this embodiment), the output voltage of the air-fuel ratio sensor 40 becomes higher than the preset voltage $V_{Ro}$ of the comparator 100 and the output of the comparator 100 goes to a "0" level. On the contrary, when the air-fuel ratio of the exhaust gases is greater than the desired air-fuel ratio $X_{Ro}$, the output of the comparator 100 goes to a "1" level. When the output of the comparator 100 goes to the "0" level, the solenoids 68 and 69 are not energized so that atmospheric pressure is introduced into the pressure chamber 27 of the diaphragm unit 25 through the first electromagnetic three-way valve 29 and the intake vacuum is introduced into the other pressure chamber 28 through the second electromagnetic three-way valve 30, thus fully opening the control valve 24 and thereby supplying secondary air to the exhaust pipe 5. Thus, when the air-fuel ratio of the exhaust gases reaching the air-fuel ratio sensor 40 eventually becomes greater than the desired air-fuel ratio $X_{Ro}$ causing the output of the comparator 100 to go to the "1" level, the solenoids 68 and 69 are energized so that the intake vacuum is introduced into the one pressure chamber 27 and the atmospheric pressure is introduced into the other pressure chamber 28, thus fully closing the control valve 24 and thereby interrupting the supply of secondary air.

By thus fully opening and fully closing the control valve 24 repeatedly, the secondary air is supplied as a pulsating air flow and mixed with the exhaust gases. Consequently, the air-fuel ratio of the exhaust gases introduced into the exhaust gas reactor 10 is repeatedly caused to become periodically greater than and smaller than the desired air-fuel ratio $X_{Ro}$ as shown in FIG. 5, so that the average air-fuel ratio of the exhaust gases is maintained at the desired air-fuel ratio $X_{Ro}$ and the exhaust gas reactor 10 is operated with an improved efficiency.

By reducing this period and allowing the secondary air to mix satisfactorily with the exhaust gases, it is possible to maintain the air-fuel ratio of the exhaust gases introduced into the exhaust gas reactor 10 at the desired air-fuel ratio $X_{Ro}$ and thereby further improve the purification efficiency of the exhaust gas reactor 10. For this purpose, in the present embodiment the supply pipe line 22 is provided at its open end with an extension pipe line 90 to extend in the direction of flow of exhaust gases within the exhaust pipe 5 and the pipe line 90 is formed with a plurality of ports 91 which are arranged along the flow direction of exhaust gases and through which the secondary air is permitted to flow from the line 22 to the exhaust pipe 5. While the forward end of the extension pipe line 90 may either be an open end or closed end, if it is opened, the opening should preferably be smaller than that of the ports 91.

Figure 5:
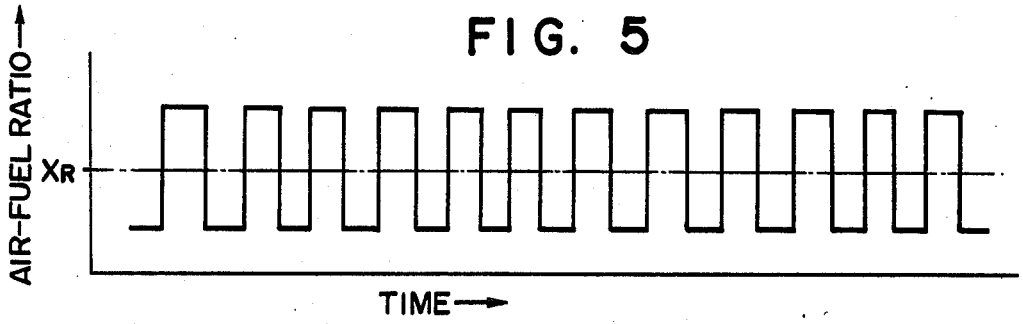
FIG. 5 is a waveform diagram useful in explaining the operation of the embodiment shown in FIG. 2.

With the provision of a plurality of these ports 91, the mixing of secondary air with exhaust gases as shown in FIG. 5 is further improved with the result that ultimately the deviation of the actual air-fuel ratio of exhaust gases with respect to the desired air-fuel ratio $X_{Ro}$ is reduced and the period of variation of air-fuel ratio is increased, thus obtaining a stable and high secondary air supply frequency and ensuring a high purification percentage for the exhaust gas reactor 10.

Of course, the spacing between the secondary air feeding ports 91 has an effect on the variations in the air-fuel ratio of exhaust gases. Thus, as an aim to be attained, the volume of the exhaust pipe 5 between the port located at the most upstream side and that located at the most downstream side should preferably be equal to or greater than the volume of the exhaust gas reactor 10 and moreover the distance between the extreme ports 91 should preferably be divided into a plurality of equal parts. Further, since the secondary air pressure at the ports 91 differs depending on their positions, the opening area of the low pressure side ports 91 should preferably be increased.

The diaphragm unit 25 is designed so that the air flow control valve 24 is operated in accordance with the displacement of the diaphragm 26 which is caused by the difference in pressure between the pressure chambers 27 and 28 on both sides of the diaphragm 26, and its feature resides in that no spring is used to support the diaphragm 26. This fact of using no diaphragm supporting spring has the effect of allowing the diaphragm 26 to respond rapidly to even a slight pressure difference and thereby ensuring rapid follow up or response during, for example, acceleration and deceleration periods of an engine where the air-fuel ratio of exhaust gases is varied rapidly. Moreover, by virtue of the fact that the diaphragm unit 25 can operate the control valve 24 by changing the pressures applied to the pressure chambers 27 and 28 by means of small solenoid valves, it is possible to use a controlling electric circuit of a smaller capacity than one which is required when the supply pipe line 22 is directly opened and closed by means of solenoid valves. Thus, by virtue of its improved response characteristic and ability to control the air-fuel ratio of exhaust gases with a high degree of accuracy, the apparatus of this invention can be advantageously used with the three-way catalyst whose range of desired air-fuel ratios is limited.

While, in the above-described embodiment as well as other embodiments which will be described later, the intake vacuum and atmospheric pressure are selectively applied to the pressure chambers 27 and 28 of the diaphragm unit 25, the air pressure delivered by the air pump may be used in place of the atmospheric pressure. Further, a pre-adjusted restrictor, flow control valve adapted to be controlled in accordance with the intake vacuum or back pressure, flow control valve controlled in accordance with the venturi pressure, relief valve, check valve or the like may be provided in the supply pipe line 22 to control the amount of air flow.

Still further, where the exhaust gas reactor 10 comprises a reducing catalyst, it is desirable to control the air-fuel ratio of exhaust gases at around 13.5 to 14.7:1 and the control may be effected in the similar manner as the above-mentioned case employing the three-way catalyst.

Figure 6:
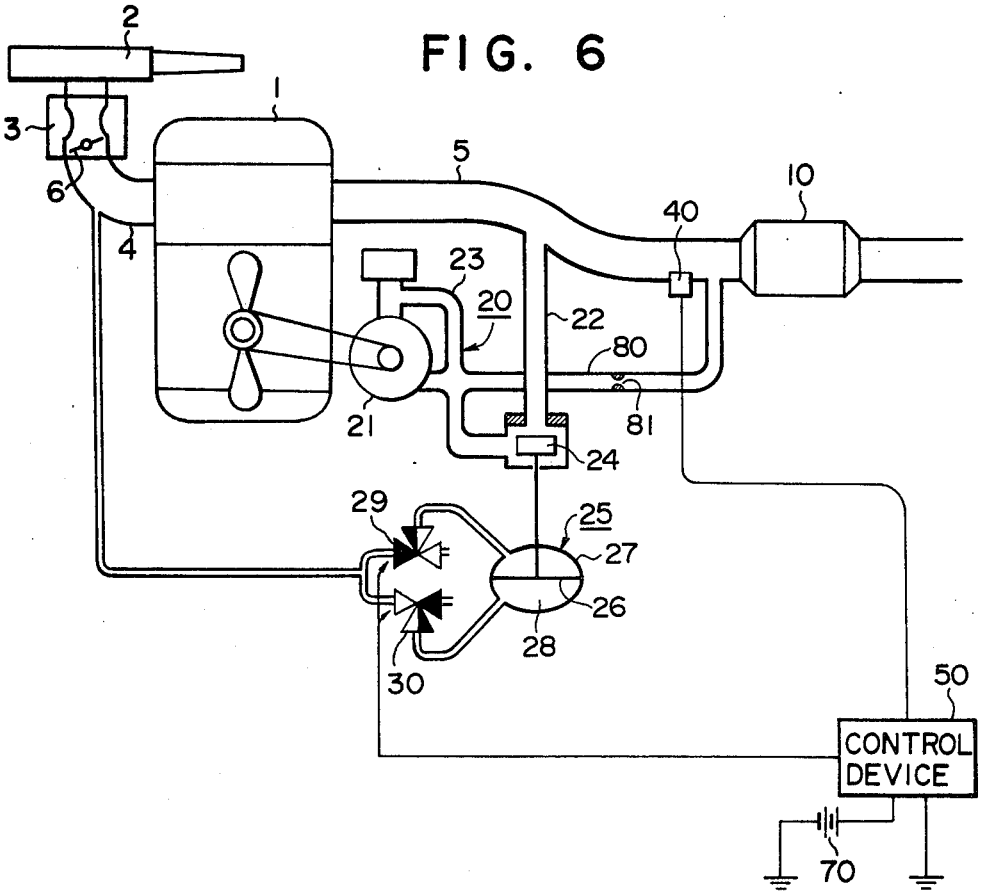
FIG. 6 is a schematic diagram showing a second embodiment of the exhaust gas purification apparatus of the invention.

Still further, where the exhaust gas reactor 10 is selected from an oxidizing catalyst, reactor, after-burner or the like, it is desirable to control the air-fuel ratio of exhaust gases at around 15.5 to 19.0:1. Thus, as in the case of the second embodiment shown in FIG. 6, the air-fuel ratio sensor 40 may be mounted in the exhaust pipe 5 upstream of the exhaust gas reactor 10 so as to control the air-fuel ratio of exhaust gases at around 14.7:1 at this position, and an auxiliary supply pipe line 80 may be branched off from the portion of the supply pipe line 22 which is nearer to the air pump 21 and remote from the control valve 24 so that a small amount of air is constantly supplied through the auxiliary supply pipe line 80 to the portion of the exhaust pipe 5 which is downstream of the air-fuel ratio sensor 40 and upstream of the exhaust gas reactor 10 to always control the air-fuel ratio of the exhaust gases reaching the exhaust gas reactor 10 at around 15.5 to 19.0:1. In this embodiment, a restrictor 81 is provided in a portion of the auxiliary supply pipe line 80 to regulate the amount of air supplied therethrough. Other construction and operation are the same as that of the embodiment of FIG. 2, whereby the detailed explanation is omitted.

In the above embodiments, the air pump 21 is employed as the secondary air supply means 20. However, the air pump 21 can be replaced by a well-known reed valve made of a thin metal plate which supplies secondary air to the exhaust pipe 5 in response to the exhaust gas pressure (the negative pressure in the exhaust pipe).

Figure 7:
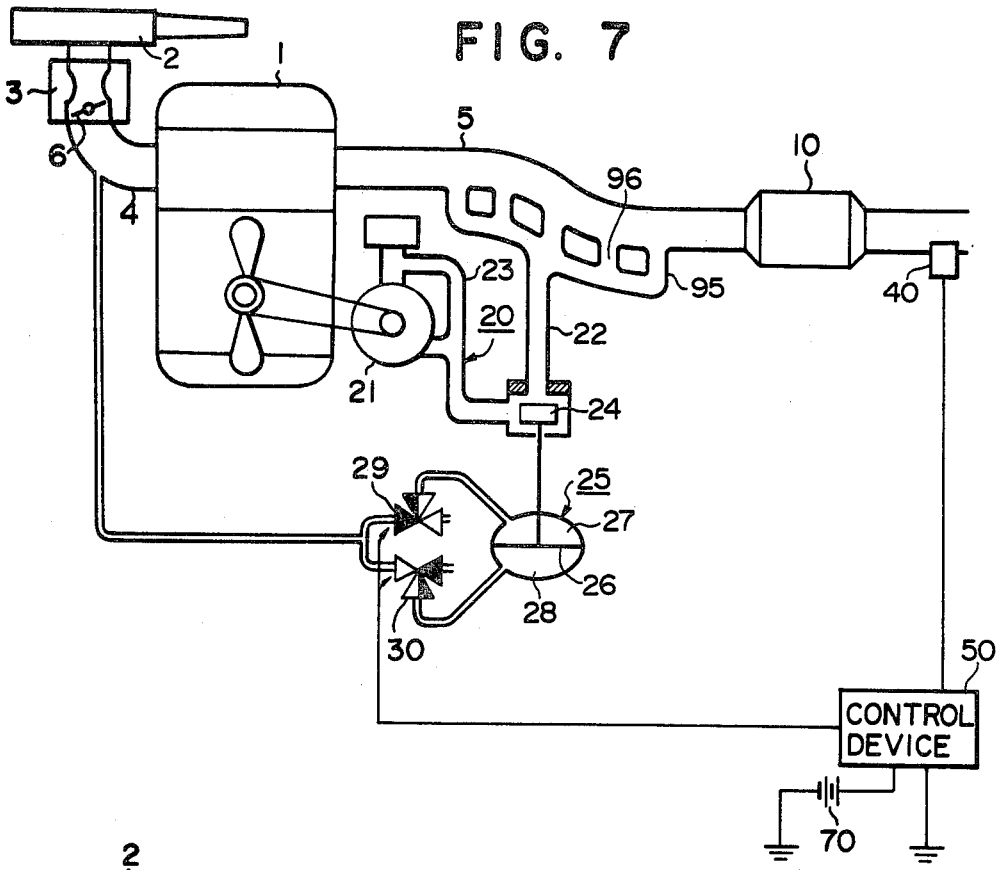
FIG. 7 is a schematic diagram showing a third embodiment of the apparatus of the invention.

FIG. 7 shows a third embodiment of the invention which is a modification of the previously described first embodiment shown in FIG. 2. The end of the supply pipe line 22 is divided into a plurality of branches 95 whose open ends 96 are opened into the exhaust pipe 5 and are arranged successively along the direction of flow of exhaust gases, thereby performing the similar function and producing the similar effect as the above-described second embodiment.

Although not shown in the FIG., the supply pipe line 22 may be provided with a bypass passage so that when the supply pipe line 22 is fully opened by a control valve such as shown at numeral 24, the bypass valve is closed by another control valve, whereas when such control valve as shown at 24 is in any position other than its fully open position, the bypass valve is opened by said another control valve to discharge a part or whole of the secondary air to the atmosphere.

To summarize, principal advantages of the exhaust gas purification apparatus of the invention described hereinbefore include the following. Firstly, the circuit construction of control circuitry is extremely simple and inexpensive, since its sole function is to detect whether the output voltage of an air-fuel ratio sensor is higher or lower than a preset voltage. Secondly, the construction of an air flow control valve is simple since it is required only to fully open and fully close a supply pipe line for a secondary air. Thirdly, by virtue of the fact that the air-fuel ratio of exhaust gases is controlled by a control valve (on-off valve) having a good response characteristic, the air-fuel ratio of exhaust gases can be properly controlled throughout the range of operating conditions of an engine, particularly during the acceleration operation of the engine where the harmful content of exhaust gases or $NO_x$ is produced in a great amount, thus reducing the variations in the air-fuel ratio of exhaust gases in an exhaust gas reactor and thereby allowing the reactor to purify the harmful contents of exhaust gases with the maximum efficiency. Fourthly, by virtue of the fact that the air-fuel ratio of exhaust gases is controlled by controlling the amount of secondary air supplied to the exhaust system, even if the supply of secondary air is effected in an on-off manner (i.e., the control valve is either fully opened or fully closed), this does not practically affect the operating efficiency of an engine and thus the transient response requirements are met satisfactorily. Thus, by properly controlling the amount of secondary air flow, the exhaust gas reactor is allowed to purify the harmful contents of exhaust gases with the maximum efficiency and thereby minimize the emission of the harmful exhaust contents to the atmosphere.

Figure 8:
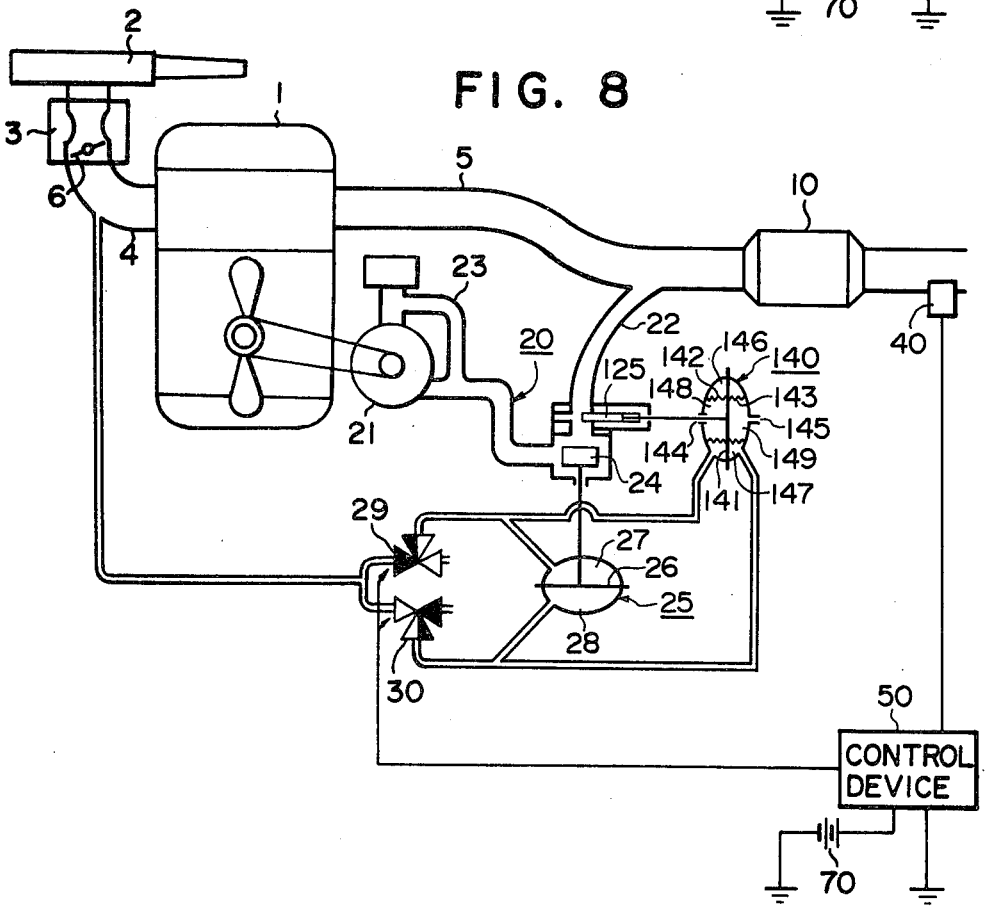
FIG. 8 is a schematic diagram showing a fourth embodiment of the apparatus of the invention.

Next, the fourth embodiment of the invention shown in FIG. 8 will be described.

It has been confirmed by experiments that the three-way catalyst can exhibit a high degree of purification efficiency when the frequency of variation in the air-fuel ratio of exhaust gases supplied to the three-way catalyst is higher than a certain frequency and that this frequency is on the order of 3 Hz. Thus, this embodiment differs from the previously described embodiments in that a second air flow control valve 125 is arranged in series with the first air flow control valve 24 so as to be arranged sequentially downstream of the relief passage 23. In other words, the amount of air delivered by the air pump 21 is supplied to the exhaust pipe 5 under the control of both the first and second control valves 24 and 125. The first control valve 24 is intermittently opened and closed by the first diaphragm unit 25 connected to the former and constituting first actuating means. This first diaphragm unit 25 is equivalent in its construction and operation to the diaphragm unit 25 shown in FIG. 2. The second control valve 125 is variably operated by a second diaphragm unit 140 connected to the former and constituting second actuating means. The second diaphragm unit 140 comprises a diaphragm 141, first and second bellows 142 and 143, and first and second small-diameter orifices 144 and 145. Either the negative pressure in the intake pipe 4 or atmospheric pressure is introduced through the first electromagnetic three-way valve 29 into a first pressure chamber 146 defined by the diaphragm 141 and the outer peripheral surface of the first bellows 142, and similarly either the negative pressure or atmospheric pressure is introduced through the second electromagnetic three-way valve 30 into a second pressure chamber 147 defined by the diaphragm 141 and the outer peripheral surface of the second bellows 143. On the other hand, the atmospheric pressure is introduced into or discharged through the orifices 144 and 145, respectively, from a first orifice chamber 148 defined by the diaphragm 141 and the inner peripheral surface of the first bellows 142 and a second orifice chamber 149 defined by the diaphragm 141 and the inner peripheral surface of the second bellows 143. The second diaphragm unit 140 will not be displaced rapidly even if a pressure difference is produced across the diaphragm 141 by the action of the orifice chambers 148 and 149 and the orifices 144 and 145, and it functions to change the degree of opening of the second control valve 125 when the negative pressure is introduced into either one of the first and second pressure chambers 146 and 147 for some increased length of time. Of course, it is needless to say that the size of the orifice chambers 148 and 149 and the orifices 144 and 145 must be determined in consideration of various conditions.

Figure 9A:
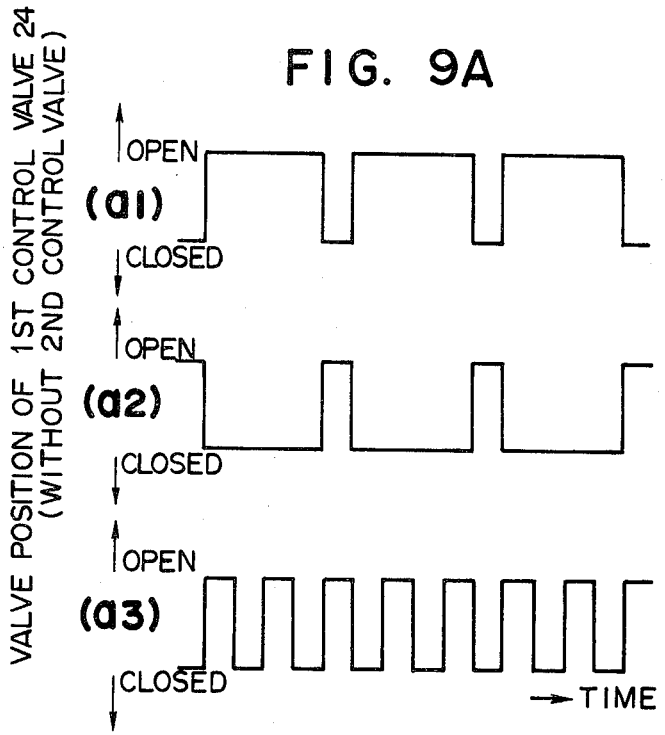
FIG. 9A and 9B show waveform diagrams useful in explaining the operation of the fourth embodiment shown in FIG. 8.

The operation of the fourth embodiment will now be described with reference to FIGS. 3 and 8. In FIG. 3, when the air-fuel ratio of the exhaust gases reaching the air-fuel ratio sensor 40 is smaller than the desired air-fuel ratio $X_R$, the first and second diaphragm units 25 and 140 of FIG. 8 respectively operate the first and second control valves 24 and 125 to move in their valve opening directions to supply secondary air. On the contrary, when the air-fuel ratio of the exhaust gases is greater than the desired air-fuel ratio $X_R$, the first and second control valves 24 and 125 are operated to move in their valve closing directions to stop the supply of secondary air. As mentioned previously, the second diaphragm unit 140 is designed to vary the degree of opening of the second control valve 125 when the intake vacuum is introduced into either one of the pressure chambers 146 and 147 for some increased length of time, and its operation and the operation of the associated components will now be described in detail. Referring to FIG. 9A, ($a_1$) to ($a_3$) show the waveforms illustrating the operation of the first control valve 24 without the second control valve 125, while in FIG. 9B ($b_1$) to ($b_3$) show the waveforms illustrating the operation of the first control valve 24 with the second control valve 125. The first control valve 24 is actuated to open and close as shown in ($a_1$), ($a_3$) and ($a_3$) of FIG. 9A when the second control valve is not provided, wherein the secondary air passing through the opened first control valve 24 flows to the exhaust pipe 5 through the supply line 22 whose passing area is not controlled (that is, the sectional area of the supply line 22 is constant).

As ($a_1$) of FIG. 9A shows, the opening duration of the control valve 24 is longer than the closing duration of the valve 24, indicating such an operating condition of the engine where a relatively rich mixture is supplied to the engine and the large amount of the secondary air is required.

As ($a_2$) of FIG. 9A shows, the closing duration is longer than the opening duration of the valve 24 contrary to ($a_1$) indicating an operating condition where a relatively small amount of the secondary air is required.

Figure 9B:
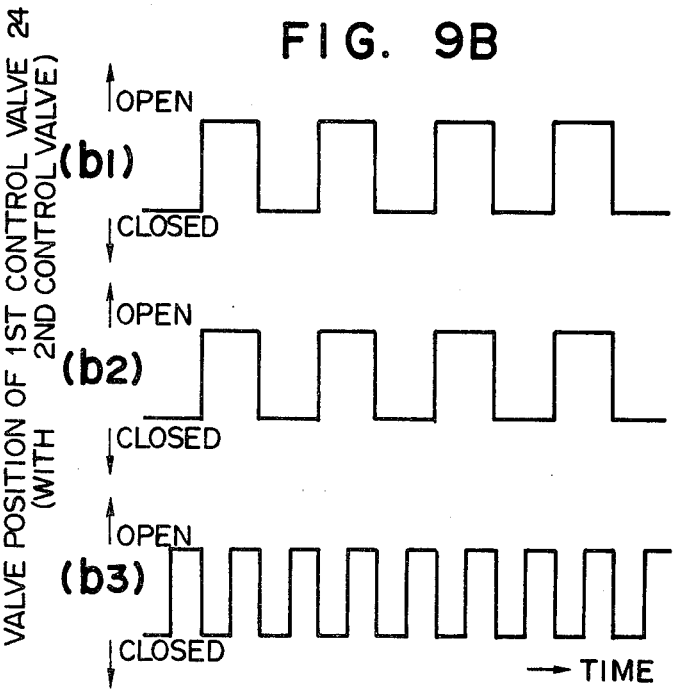

Now the operation of this embodiment with the second control valve 125 will be explained with reference to FIG. 9B, where three operating conditions of the embodiment are shown in comparison with that shown in FIG. 9A.

At first, when the large amount of the secondary air is required as in the case of ($a_1$) of FIG. 9A, the intake vacuum is introduced into the pressure chamber 28 as well as the pressure chamber 147 through the second electromagnetic three-way valve 30, while the atmospheric pressure is introduced into the pressure chamber 27 as well as the chamber 146 through the first electromagnetic three-way valve 29, so as to open the first control valve 24 and also to actuate the second control valve 125 in a wider opening direction. When the first control valve 24 is opened, the secondary air is supplied to the exhaust pipe 5 under the control of the second control valve 125. When the large amount of the secondary air is required, the first control valve 24 tends to be kept opened longer as explained above so that the passing area (sectional area) of the supply line 22 is actuated to become larger. Therefore, a certain amount of the secondary air required for the stoichiometric reaction of the exhaust gases can be supplied to the exhaust pipe 5 in a shorter time as compared with that of the case where the secondary control valve 125 is not provided, whereby the frequency of the opening and closing operation of the first control valve 24 is increased as shown in ($b_1$) of FIG. 9B.

More detailed explanation is as follows: When the amount of the secondary air supplied to the exhaust pipe for a unit time (that is, a secondary air supply rate) is increased, the time duration during which the secondary air is supplied (that is, the time duration during which the first control valve 24 is opened) is naturally decreased. Further, when the time duration thereof is decreased, the amount of the exhaust gases flowing during that time duration through the exhaust pipe 5 is decreased, so that the amount of the secondary air required for the stoichiometric reaction of the exhaust gases flowing during that time duration is in turn decreased. Accordingly, the time duration during which the secondary air is supplied is decreased, whereby the frequency of the opening and closing operation of the first control valve is increased.

Secondary, when the relatively small amount of the secondary air is required as in the case of ($a_2$) of FIG. 9A, the intake vacuum is introduced into the pressure chamber 27 as well as the pressure chamber 146 through the first electromagnetic three-way valve 29, while the atmospheric pressure is introduced into the pressure chambers 28 and 147 through the second electromagnetic three-way valve 30, so as to close the first control valve 24 and also to actuate the second control valve in a closing direction. Of course, the first control valve 24 is intermittently opened and closed. When the small amount of the secondary air is required, the first control valve 24 tends to be closed longer as explained above with reference to ($a_2$) of FIG. 9A, so that the passing area of the supply line 22 is actuated to become smaller. Therefore, when the first control valve 24 is opened to supply a certain amount of the secondary air required for the stoichiometric reaction of the exhaust gases, the secondary air is supplied slowly and thereby the time duration during which the first control valve is opened is increased as shown in ($b_2$) of FIG. 9B. On the other hand, when the frequency of the opening and closing operation of the valve 24 is high as shown in ($a_3$) of FIG. 9A, the intake vacuum is alternately introduced into the first and second pressure chambers 146 and 147 of the second diaphragm unit 140 for a decreased length of time so that the diaphragm 141 is not practically displaced and the second control valve 125 connected to the diaphragm 141 practically maintains its then existing degree of opening, thus producing no effect on the operation of the first control valve 24 as shown in ($b_3$) of FIG. 9B. Consequently, in any case, the first control valve 24 is opened and closed at a frequency higher than a certain frequency and the ratio between the opening duration and the closing duration of the first control valve 24 is controlled practically at 1:1. Thus, by selecting the size of the orifices 144 and 145 and the pressure chambers 146 and 147 to assume suitable values, it is possible to preferably maintain the frequency higher than 3 Hz. In this case, although the air-fuel ratio of exhaust gases is varied in a pulse-like manner, the desired air-fuel ratio $X_R$ is attained on an average.

With the above-described exhaust gas purification apparatus, under all the operating conditions of an engine the proper amount of secondary air can be supplied at a frequency higher than a certain value (e.g., about 3 Hz) with the ratio between the opening and closing durations being held at 1:1. Particularly, during transient periods such as acceleration periods of an engine the air-fuel ratio of exhaust gases can be maintained at the optimum value for the maximum purification efficiency of the three-way catalyst.

Figure 10:
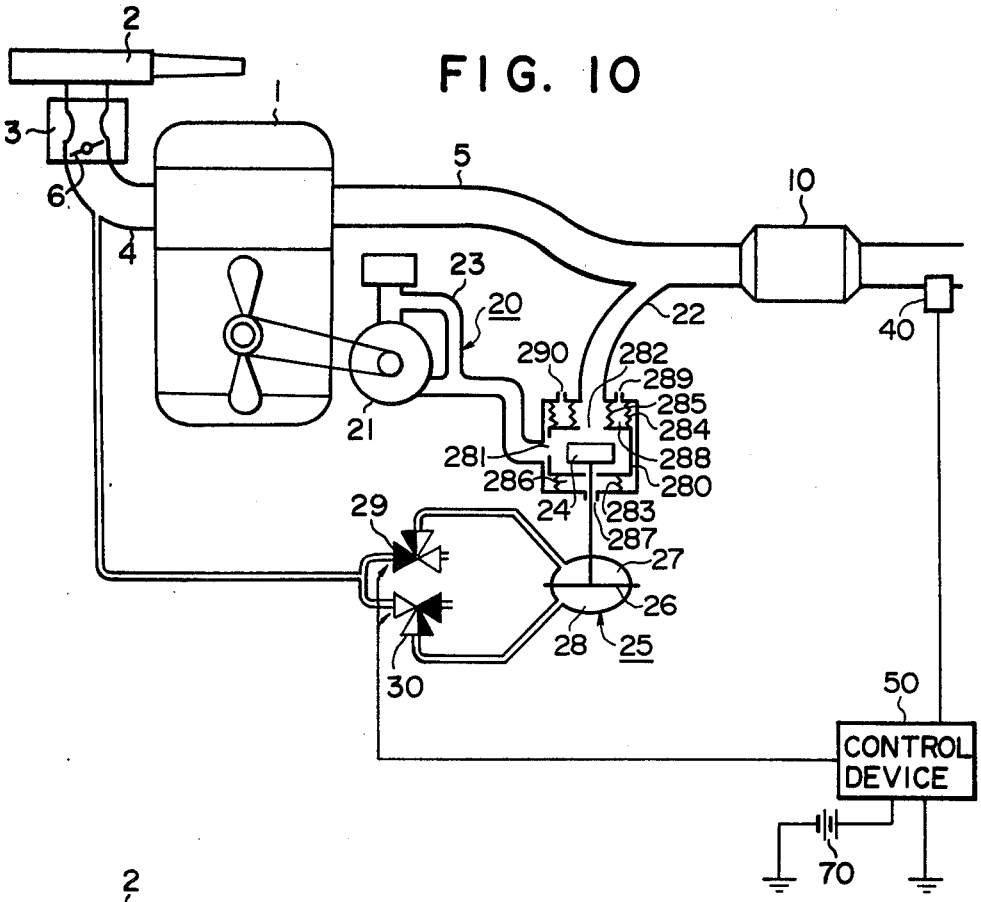
FIG. 10 is a schematic diagram showing a fifth embodiment of the apparatus of the invention.

FIG. 10 shows a fifth embodiment of the invention which differs from the fourth embodiment in that the functions of the second control valve and the second diaphragm unit are performed by a different arrangement. In the Figure, numeral 280 designates a box type second control valve having first and second openings 281 and 282 communicating with the supply pipe line 22, and the relative positions of the first opening 281 and the associated opening of the supply pipe line 22 are controlled by the movement of the second control valve 280 so that when the second control valve 280 is moved downward in the Figure, the opening area is increased. The second opening 282 is opened and closed by the first control valve 24 disposed within the second control valve 280. The second control valve 280 is held in place in the supply pipe line 22 by first, second and third bellows 283, 284 and 285 constituting a damper unit. A first orifice chamber defined by the first bellows 283 is opened to the atmosphere through a first orifice 287, and a second orifice chamber 288 defined by the second and third bellows 284 and 285 is opened to the atmosphere by way of second and third orifices 289 and 290. The second control valve 280 is operated by the first control valve 24 to vary the degree of opening of the first opening 281. The orifices 287, 289 and 290 are preset to meet the requirements. When there exists a condition such as shown by ($a_1$) of FIG. 9A where a large amount of the secondary air is required, the first control valve 24 is displaced downward in FIG. 10 for an increased length of time and thus the second control valve 280 is also forced downward, thereby discharging the air in the first orifice chamber 286 to the atmosphere through the first orifice 287 and also causing the first opening 281 to increase the passage area of the supply pipe line 22. In this case, when the first control valve 24 is displaced upward in FIG. 10 for a decreased length of time to close the first control valve 24, the air in the second orifice chamber 288 is not discharged rapidly to the atmosphere. Consequently, the upward movement of the first control valve 24 is restrained and the first opening 281 holds the passage of the supply pipe line 22 wide open. In this way, a large quantity of secondary air is supplied into the exhaust pipe 5 so that the air-fuel ratio of the exhaust gases is rapidly controlled and the duration of opening of the first control valve 24 is decreased, thus controlling the first control valve 24 as shown by ($b_1$) of FIG. 9B. On the other hand, when there exists a condition as shown by ($a_2$) of FIG. 9A where a small amount of the secondary air is required, the first control valve 24 is displaced upward to close the first control valve 24 in FIG. 10 for an increased length of time and thus the second control valve 280 is also forced upward, thereby discharging the air in the second orifice chamber 288 to the atmosphere through the second and third orifices 289 and 290 and also causing the first opening 281 to decrease the passage area of the supply pipe line 22. Thus, the first control valve 24 is controlled as shown by ($b_2$) of FIG. 9B. On the other hand, when there exists a condition as shown by ($a_3$) of FIG. 9A, the second control valve 280 is continuously forced upward and downward by the first control valve 24 for a decreased length of time and the air in the first and second orifice chambers 286 and 288 is not rapidly discharged to the atmosphere. Consequently, the relative positions of the first opening 281 and the associated opening of the supply pipe line 22 are not practically varied and the on-off pulses for the first control valve 24 are affected in no way.

Thus, the similar operation and effect as the fourth embodiment can be attained by this embodiment.

Figure 11:
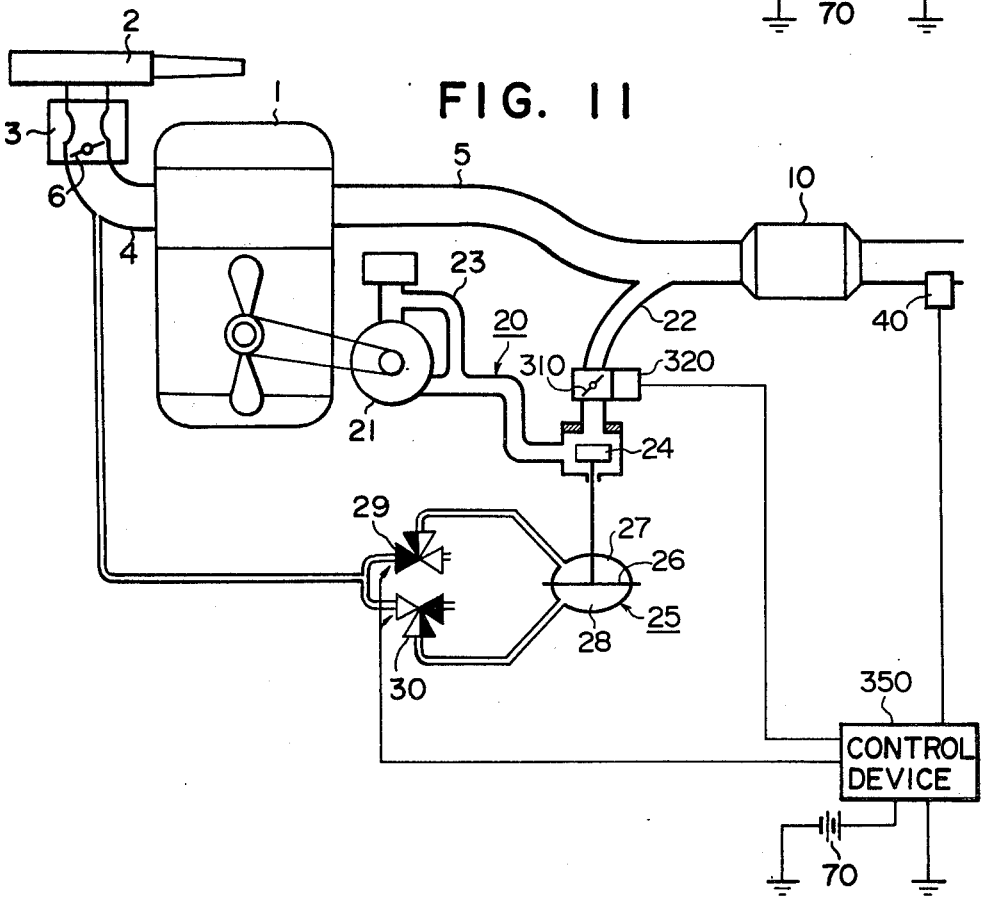
FIG. 11 is a schematic diagram showing a sixth embodiment of the apparatus of the invention.

FIG. 11 shows a sixth embodiment of the invention. This embodiment differs from the previously mentioned embodiments in that a second control valve 310 is operated by a pulse motor 320, and a control device 350 including a control device which is basically the same with the control device 50 of FIG. 4 and also including a pulse motor drive unit which operates the pulse motor 320 in response to the output of the air-fuel ratio sensor 40.

Figure 12:
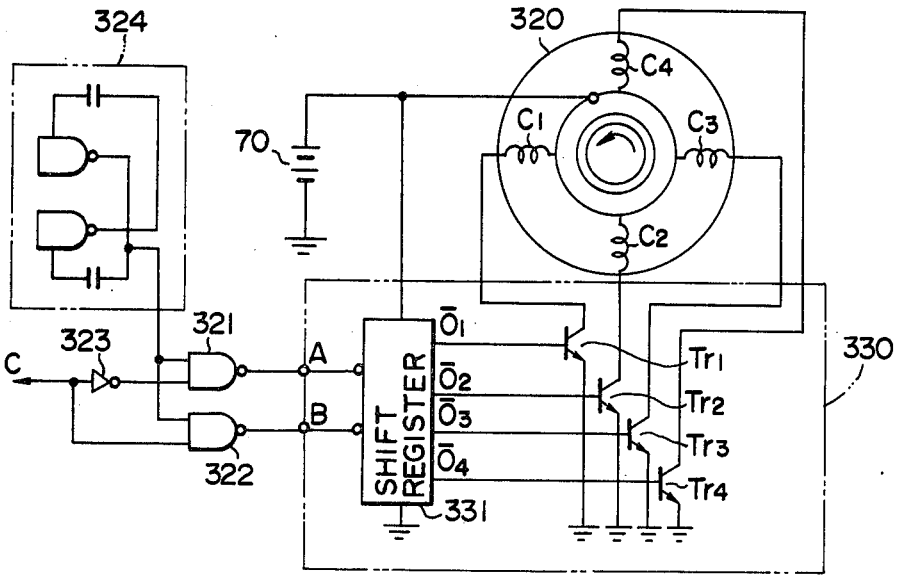
FIG. 12 is a circuit diagram for the pulse motor and its driving means used in the sixth embodiment shown in FIG. 11.
Figure 13A:
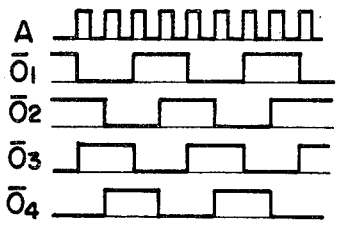
FIGS. 13A and 13B are waveform diagrams which are useful in explaining the operation of the circuitry shown in FIG. 12.
Figure 13B:
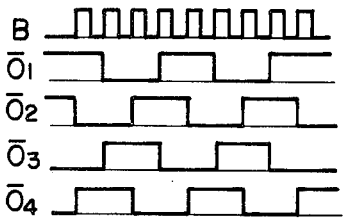

The pulse motor drive unit is constructed as shown in FIG. 12, in which numerals 321 and 322 designate NAND circuits, 323 a NOT circuit, 324 a pulse oscillator. A terminal C is connected to the output of the comparator 100 in the control device 50. Numeral 330 designates a driving circuit for controlling the direction of rotation and the degree of rotation of the pulse motor 320 and it comprises a shift register 331 and four transistors $T_{r1}$ to $T_{r4}$.

The pulses from the pulse oscillator 324 are logically operated on by either the NAND circuit 321 or 322 in accordance with the output level of the comparator 100 and then applied to the pulse motor driving circuit 330. When the output of the comparator 100 in the control device 350 goes to the "0" level, the pulses are applied to an input terminal A of the shift register 331 so that its output terminals $\overline{O}_1$ to $\overline{O}_4$ are sequentially shifted in this order and the transistors $T_{r1}$ to $T_{r4}$ are also sequentially turned on in this order. Consequently, coils $C_1$, $C_2$, $C_3$ and $C_4$ of the pulse motor 320 are similarly energized two phases at a time and the rotor of the pulse motor 320 is rotated in the direction of the arrow. Thus, the second control valve 310 is opened to increase the amount of air supplied. On the contrary, when the output of the comparator 100 goes to the "1" level, the pulses are applied to an input terminal B of the shift register 331 so that the output terminals $\overline{O}_1$ to $\overline{O}_4$ are sequentially shifted in the order of $\overline{O}_4$, $\overline{O}_3$, $\overline{O}_2$ and $\overline{O}_1$ and the pulse motor 320 is rotated in a direction opposite to the direction of the arrow, thus closing the second control valve 310.

With this construction, when there exists the condition shown by ($a_1$) of FIG. 9A where a large amount of the secondary air is required, the second control valve 310 is moved in the valve opening direction for an increased length of time and it is moved in the valve closing direction for a decreased length of time. Consequently, the second control valve 310 maintains its passage wide open and an increased amount of secondary air is supplied into the exhaust pipe 5 and the air-fuel ratio of the exhaust gases is rapidly controlled thus obtaining the condition shown by ($b_1$) of FIG. 9B. On the contrary, when there exists the condition shown by ($a_2$) of FIG. 9A where a small amount of the secondary air is required, the second control valve 310 is moved in the valve closing direction for a longer period of time than in the valve opening direction with the result that the second control valve 310 maintains its passage narrow and the condition shown by ($b_2$) of FIG. 9B is obtained. On the other hand, when the first control valve 24 is operating at a frequency higher than a certain value as shown by ($a_3$) of FIG. 9A, the second control valve 310 maintains its opening substantially constant and the opening and closing operation for the first control valve 24 are not effected in any way as shown by ($b_3$) of FIG. 9B. Thus, this embodiment attains the similar effect as the previously mentioned embodiments. The second control valve 310 is not limited to a butterfly valve and it may also comprise a slide valve.

Figure 14:
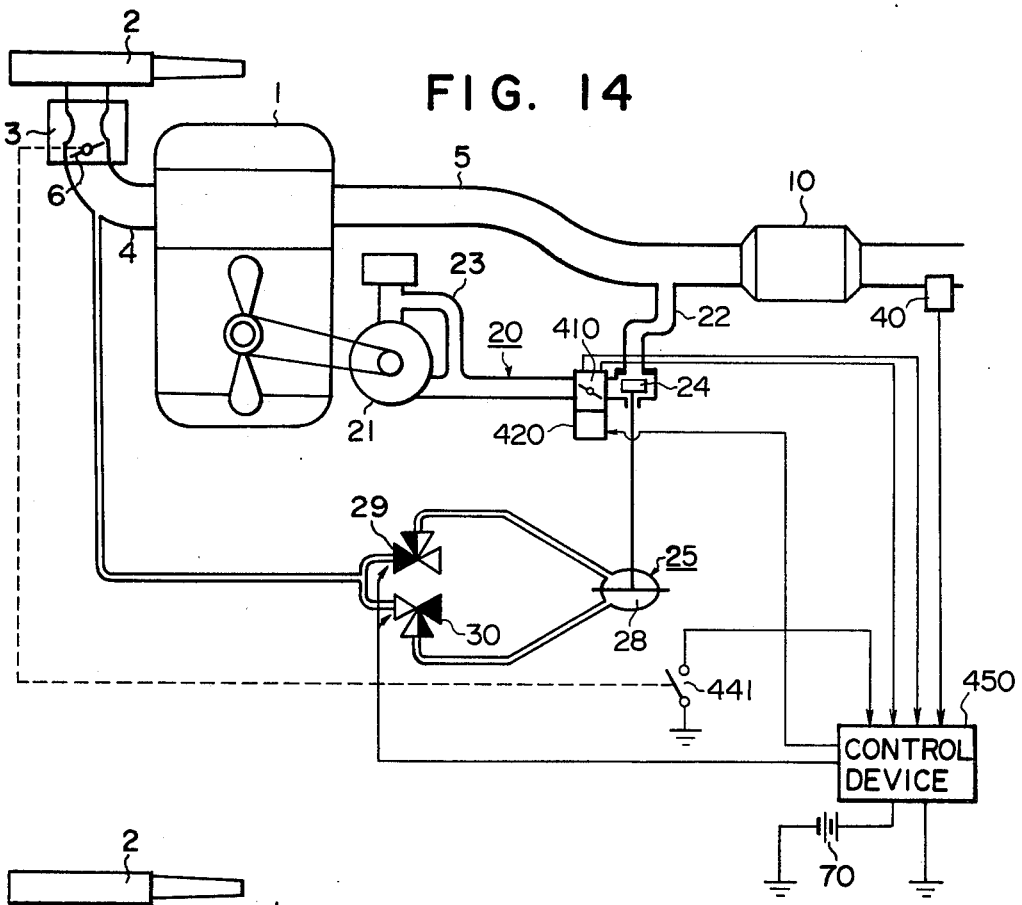
FIG. 14 is a schematic diagram showing a seventh embodiment of the apparatus of the invention.

Next, the seventh embodiment of the invention shown in FIG. 14 will be described. This embodiment differs from the previously mentioned embodiments in that while a second control valve 410 is similarly disposed in series with the first air control valve 24 so as to be sequentially arranged downstream of the relief passage 23, the amount of air flow from the air pump 21 is controlled by only either one of the first and second control valves 24 and 410 and supplied into the exhaust pipe 5. The opening of the second control valve 410 is continuously controlled by a drive motor 420 (e.g., a pulse motor). Numeral 450 designates a control device comprising electric circuitry and it receives as its inputs the output of the air-fuel ratio sensor 40, the output of a throttle switch 441 responsive to the movement of the throttle valve 6 and the outputs of a fully-open position switch 442 and a fully-closed position switch 443 for the second control valve 410 (the switches 442 and 443 are not shown in FIG. 14), whereby the inputs are operated on and the drive motor 420 for the second control valve 410 and the electromagnetic three-way valves 29 and 30 for the first control valve 24 are operated in accordance with the result of the operation on the inputs. The throttle switch 441 is turned on (closed) when the opening of the throttle valve 6 is less than a predetermined value, as for example, during the normal operation where the throttle opening is less than the $\frac{3}{4}$ throttle, whereas it is turned off (opened) during the high load operation where the throttle opening is greater than the $\frac{3}{4}$ throttle. The control device 450 is responsive to the operation of the throttle switch 441 so that when the throttle switch 441 is turned on (closed), the first control valve 24 is fully opened and instead the drive motor 420 of the second control valve 410 is rotated in the forward or reverse direction in accordance with the output of the air-fuel ratio sensor 40 in order to control the amount of the secondary air by the control valve 410. On the contrary, when the throttle switch 441 is turned off (opened), the second control valve 410 is fully opened and instead the electromagnetic three-way valves 29 and 30 of the first control valve 24 are operated in accordance with the output of the air-fuel ratio sensor 40 in order to control the amount of the secondary air by the first control valve 24.

Figure 15:
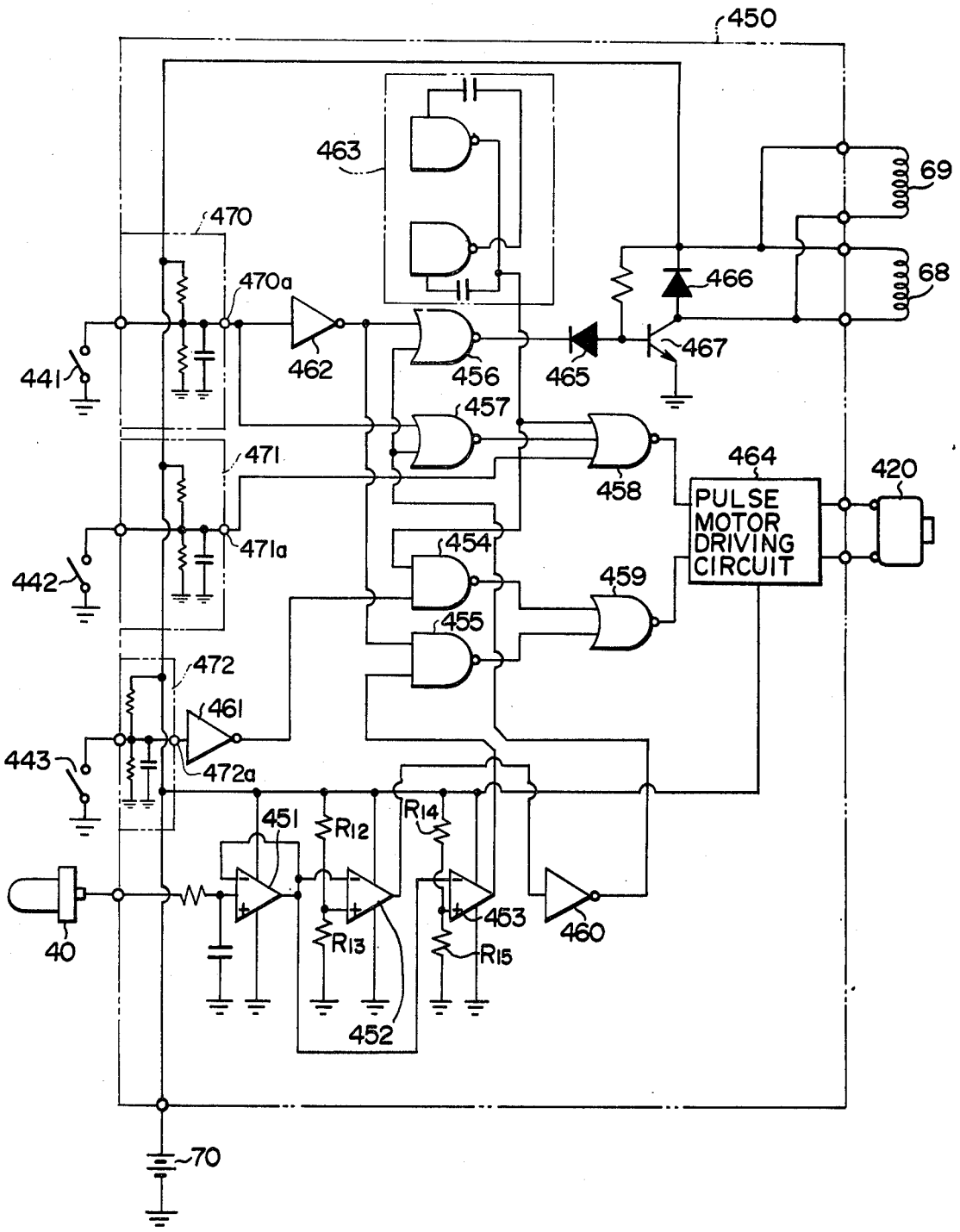
FIG. 15 is a circuit diagram of the control device used in the seventh embodiment shown in FIG. 14.

FIG. 15 shows a detailed wiring diagram of the control device 450. In the Figure wherein the drive motor 420 for operating the second control valve 410 comprises a pulse motor, numeral 451 designates an amplifier for amplifying the signal from the air-fuel ratio sensor 40, 452 and 453 comparators for respectively comparing the output voltage of the amplifier 451 with a voltage preset by resistor $R_{12}$ and $R_{13}$ and a voltage preset by resistors $R_{14}$ and $R_{15}$, respectively.

The preset voltage of the first comparator 452 is preset to the output voltage $V_R$ of the air-fuel ratio sensor 40 corresponding to a desired air-fuel ratio $X_R$, and the preset voltage of the second comparator 453 is preset to the output voltage $V_L$ of the air-fuel ratio sensor 40 corresponding to another desired air-fuel ratio $X_L$, wherein $X_L$ is larger than $X_R$ as shown in FIG. 3. Therefore, when the air-fuel ratio detected by the sensor 40 is lower than $X_R$, "0" level signals are produced at both output terminals of the comparators 452 and 453, while "1" level signals are produced at both output terminals of the comparators 452 and 453 when the air-fuel ratio detected by the sensor 40 is higher than $X_L$. And when the air-fuel ratio detected by the sensor 40 is between $X_R$ and $X_L$, "1" level signal is produced at the output terminal of the first comparator 452, while "0" level signal is produced at the output terminal of the second comparator 453. In FIG. 15 numerals 454 and 455 designate NAND circuits, 456, 457, 458 and 459 NOR circuits, 460, 461 and 462 NOT circuits, 463 a pulse oscillator, 464 a driving circuit for controlling the direction of rotation and the degree of rotation of the pulse motor 420, 465 and 466 diodes, 467 a transistor, 68 and 69 the solenoids of the first and second electromagnetic three-way valves 29 and 30, 70 a power source.

Numerals 470, 471 and 472 designate signal generating circuits respectively comprising resistors and capacitor as is well known. The circuits 470, 471 and 472 are respectively connected to the switches 441, 442 and 443 and each circuit thereof generates "1" level signal when the associated switch is turned off (opened) while generating "0" level signal when the associated switch is turned on (closed) at their respective output terminals 470*a*, 471*a* and 472*a*.

With the control device 450, when the opening of the throttle valve 6 is less than the ¾ throttle so that the throttle switch 441 is turned on (closed), to thereby generate "0" level signal at the output terminal 470*a*. The NOT circuit 462 inverts the "0" level signal and then the NOR circuit 456 generates "0" level signal upon receiving the "1" level signal from the NOT circuit 462, whereby the solenoids 68 and 69 are not energized keeping the first control valve 24 fully opened.

While the first control valve 24 is kept fully opened, the second control valve 410 is operated as follows in order to control the amount of the secondary air.

At first, the operation of the fully-open position switch 442 and the fully-closed position switch 443 is described. The switch 442 is opened when the second control valve 410 is moved to its fully-open position so that the signal generating circuit 471 generates "0" level signal at its output terminal 471*a* when the second control valve 410 is not positioned at its fully-open position. The switch 443 is likewise opened when the second control valve 410 is moved to its fully-closed position so that the signal generating circuit 472 generates "0" level signal at its output terminal 472*a* when the second control valve 410 is not positioned at its fully-closed position. Accordingly, when the second control valve 410 is positioned at neither fully-open position nor the fully-closed position, "0" level signals are produced at both output terminals 471*a* and 472*a*.

When the air-fuel ratio detected by the sensor 40 is lower than the desired air-fuel ratio of $X_R$, "0" level signals are produced at both output terminals of the first and second comparators 452 and 453 as described above. The "0" level signal from the second comparator 453 is applied to one input terminal of the NAND circuit 455, the other input terminal of which is supplied with the "1" level signal from the NOT circuit 462 when the throttle switch 441 is turned on, whereby "1" level signal from the NAND circuit 455 is applied to one input terminal of the NOR circuit 459. Accordingly, the NOR circuit 459 is closed so that the pulse signals applied to the other input terminal of the NOR circuit 459 from the pulse generator 463 through the NAND circuit 454 is prohibited to pass therethrough.

On the other hand, the "0" level signal from the first comparator 452 is inverted into "1" level signal by the NOT circuit 460, which is then applied to one input terminal of the NOR circuit 457, the other input terminal of which is supplied with the "0" level signal from the signal generating circuit 470, whereby "0" level signal from the NOR circuit 457 is applied to one input terminal of the NOR circuit 458. Another input terminal of the NOR circuit 458, which is connected with the signal generating circuit 471, is supplied with the "0" level signal when the second control valve 410 is not positioned at the fully-open position, as already explained, whereby the pulse signals applied to the third input terminal of the NOR circuit 458 from the pulse generator 463 is permitted to pass therethrough and applied to the driving circuit 464. The driving circuit 464 is of the well-known type such as the circuit shown by 330 in FIG. 12. The driving circuit 464 actuates the pulse motor 420 to move the second control valve 410 in the valve opening direction when it receives pulse signals from the NOR circuit 458. As above, when the air-fuel ratio is below $X_R$, the second control valve 410 is actuated to move in the valve opening direction so that the air-fuel ratio of the exhaust gases is controlled to become larger.

When the air-fuel ratio of the exhaust gases becomes larger as described above and becomes between $X_R$ and $X_L$, the output of the first comparator 452 is changed from the "0" level to "1" level while the second comparator 453 remains the "0" level signal at its output terminal. Under this condition, the NOR circuit 459 is still kept closed, so that the pulse signals from the pulse generator 463 through the NAND circuit 454 is prohibited to pass therethrough. On the other hand, when the output of the first comparator 452 is changed from "0" level to "1" level, the "1" level signal is inverted by the NOT circuit 460 into "0" level signal which is applied to the one input terminal of the NOR circuit 457, so that the "1" level signal is applied to the one input terminal of the NOR circuit 458. Accordingly, the pulse signal applied to the other input terminal of the NOR circuit 458 is prohibited to pass therethrough, so that the actuation of the pulse motor 420 in the valve opening direction is stopped, whereby the second control valve 410 is kept at a certain opening position.

When the air-fuel ratio detected by the sensor 40 becomes higher than the other desired value of $X_L$, the "1" level signals are produced at both output terminals of the first and second comparators 452 and 453. As described above, when the "1" level signal is produced at the first comparator 452, pulse signals are not applied to the driving circuit 464 through the NOR circuit 458. When the "1" level signal is produced at the second comparator 453, the NAND circuit 455 generates "0" level signal which is then applied to the NOR circuit 459. Accordingly, pulse signals from the pulse generator 463 through the NAND circuit 454 are permitted to pass therethrough and applied to the driving circuit 464. The driving circuit 464 actuates the pulse motor 420 to move the second control valve 410 in the valve closing direction when it receives pulse signals from the NOR circuit 459. As above, when the air-fuel ratio is higher than $X_L$, the second control valve 410 is actuated to move in the valve closing direction so that the air-fuel ratio of the exhaust gases is controlled to become smaller.

As described above, the air-fuel ratio of the exhaust gases is controlled to become between $X_R$ and $X_L$ by the second control valve 410 when the opening of the throttle valve 6 is less than the ¾ throttle. In the above operation, the fully-closed and fully-open position switches 442 and 443 function as follows. When the second control valve 410 is moved to its either fully-closed or fully-open position, the output of the associated signal generating circuit 471 or 472 is changed from "0" level to "1" level. When this occurs, the pulse signals are prohibited to pass through the NOR circuit 458 or NAND circuit 454 so that the second control valve 410 is prevented from being actuated to move furthermore in either the valve opening or the valve-closing direction.

When the opening of the throttle valve 6 becomes greater than the ¾ throttle, the throttle switch 441 is turned off (opened) so that the signal generating circuit 470 generates "1" level signal at its output terminal 470*a*. When the "1" level signal is produced at the circuit 470, it is inverted by the NOT circuit 462 into "0" level signal which is then applied to the NAND circuit 455 so that the "1" level signal is applied to the NOR circuit 459 irrespective of the output from the second comparator 453. Thus, the pulse signals are not permitted to pass through the NOR circuit 459, whereby the second control valve 410 can not be actuated to move in the valve closing direction. Further, the "1" level signal from the circuit 470 is applied to the NOR circuit 457, so that the "0" level signal is in turn applied to the NOR circuit 458 irrespective of the output from the first comparator 452. Accordingly, the pulse signals from the pulse generator 463 is permitted to pass therethrough until the "1" level signal is applied to the NOR circuit 458 from the signal generating circuit 471. Since the circuit 471 generates the "1" level signal when the second control valve 410 is moved to its fully-open position, the second control valve 410 is actuated to move in the valve opening direction and kept at its fully-open position as the result of the operation of the signal generating circuit 470 and the NOR circuits 457 and 458. As above, when the opening of the throttle valve 6 becomes greater than the ¾ throttle, the second control valve 410 is kept fully-opened so that the control of the secondary air is then carried out by the first control valve 24 as described hereinafter. When the air-fuel ratio of the exhaust gases detected by the sensor 40 is below the desired air-fuel ratio of $X_R$, the first comparator 452 generates the "0" level signal which is inverted by the NOT circuit 460 into the "1" level signal. When the "1" level signal is applied to one input terminal of the NOR circuit 456, the other input terminal of which is supplied with the "0" level signal from the NOT circuit 462, the NOR circuit 456 generates "0" level signal, whereby the solenoids 68 and 69 remain deenergized keeping the first control valve 24 opened. On the other hand, when the air-fuel ratio of the exhaust gases becomes higher than $X_R$, the output of the first comparator 452 is changed from "0" level to "1" level. Therefore, the "1" level signal is inverted by the NOT circuit 460 into "0" level signal which is applied to the NOR circuit 456 so that the NOR circuit 456 generates "1" level signal. The transistor 467 is thereby driven into conduction to energize the solenoids 68 and 69 with the result that the first control valve 24 is actuated to close. As described above, when the opening of the throttle valve 6 is greater than the ¾ throttle, the second control valve 410 is kept fully-opened while the amount of the secondary air is controlled by the first control valve 24.

With these control valves 24 and 410 and the control device 450, during the normal operation of the engine the amount of secondary air flow is controlled by the second control valve 410 having the pulse motor 420 which is stable in operation, whereas during the high-load operation the amount of secondary air flow is controlled by the first control valve 24 comprising an on-off valve which is operated by the intake vacuum through the quick-operating electromagnetic valves. Thus, during the transient periods of the engine, e.g., during the acceleration periods the air-fuel ratio of exhaust gases can be controlled at the optimum value for the maximum purification efficiency of the three-way catalyst.

Figure 16:
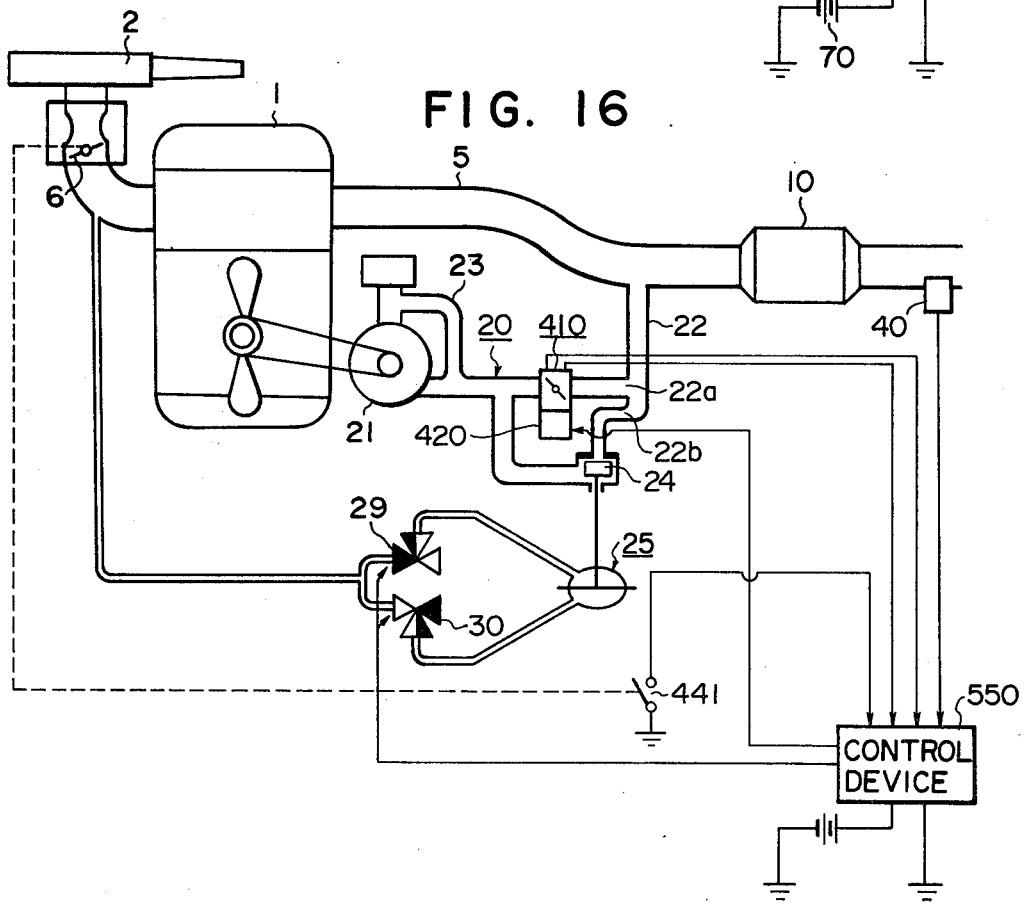
FIG. 16 is a schematic diagram showing an eighth embodiment of the apparatus of the invention.

FIG. 16 shows an eighth embodiment of the invention. This eighth embodiment differs from the above-described seventh embodiment in that in the secondary air supply means 20 the supply pipe line 22 is branched at its middle portion into two parallel passages 22*a* and 22*b* and that the second control valve 410 having the drive motor 420 is disposed in one of the branch passages and the first control valve 24 having the diaphragm unit 25 is disposed in the other passage. A control device 550 is basically the same with the control device 450 of FIG. 15 except that the signals for fully closing the first control valve 24 are applied to the electromagnetic three-way valves 29 and 30 when the throttle switch 441 is turned on, whereas the signals for fully closing the second control valve 410 are applied to the pulse motor 420 when the throttle switch 441 is turned off. This embodiment can provide the same function and effect as the previously described seventh embodiment.

Figure 17:
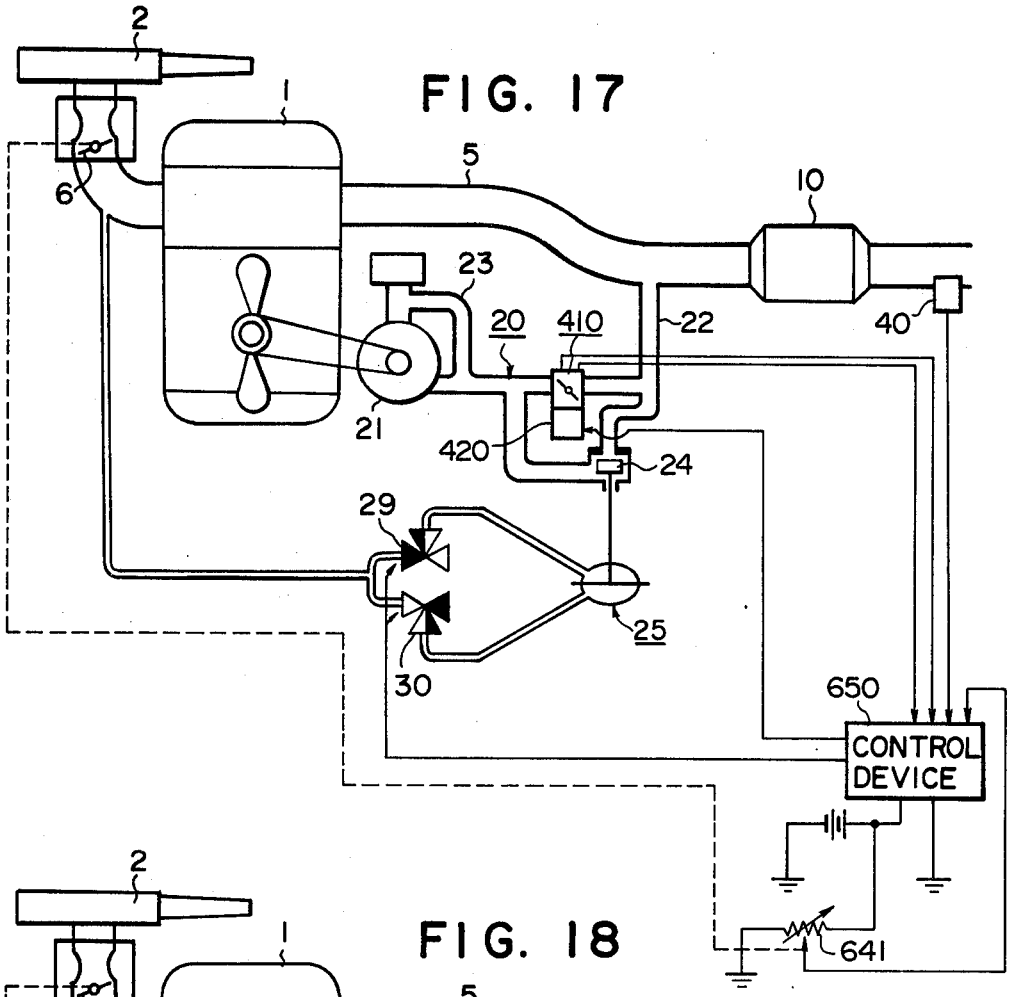
FIG. 17 is a schematic diagram showing a ninth embodiment of the apparatus of the invention.

FIG. 17 shows a ninth embodiment of the invention. This embodiment differs from the eighth embodiment in that variations in the opening of the throttle valve 6 are detected by a potentiometer 641 so that during the normal operation of the engine where the variations of the throttle opening are less than a predetermined value, the second control valve 410 is opened and closed by the control device 650 according to the output of the air-fuel ratio sensor 40. At this time, the first control valve 24 is fully closed by a full closing signal. On the other hand, during the transient periods of the engine (e.g., the periods of acceleration) where the rate of change in the output of the potentiometer 641 is greater than a predetermined value, the first control valve 24 consisting of an on-off valve which is operated by the electromagnetic valve controlled vacuum, is opened and closed by the control device 650 in accordance with the output of the air-fuel ratio sensor 40. At this time, the second control valve 410 is fully closed by a full closing signal.

Figure 18:
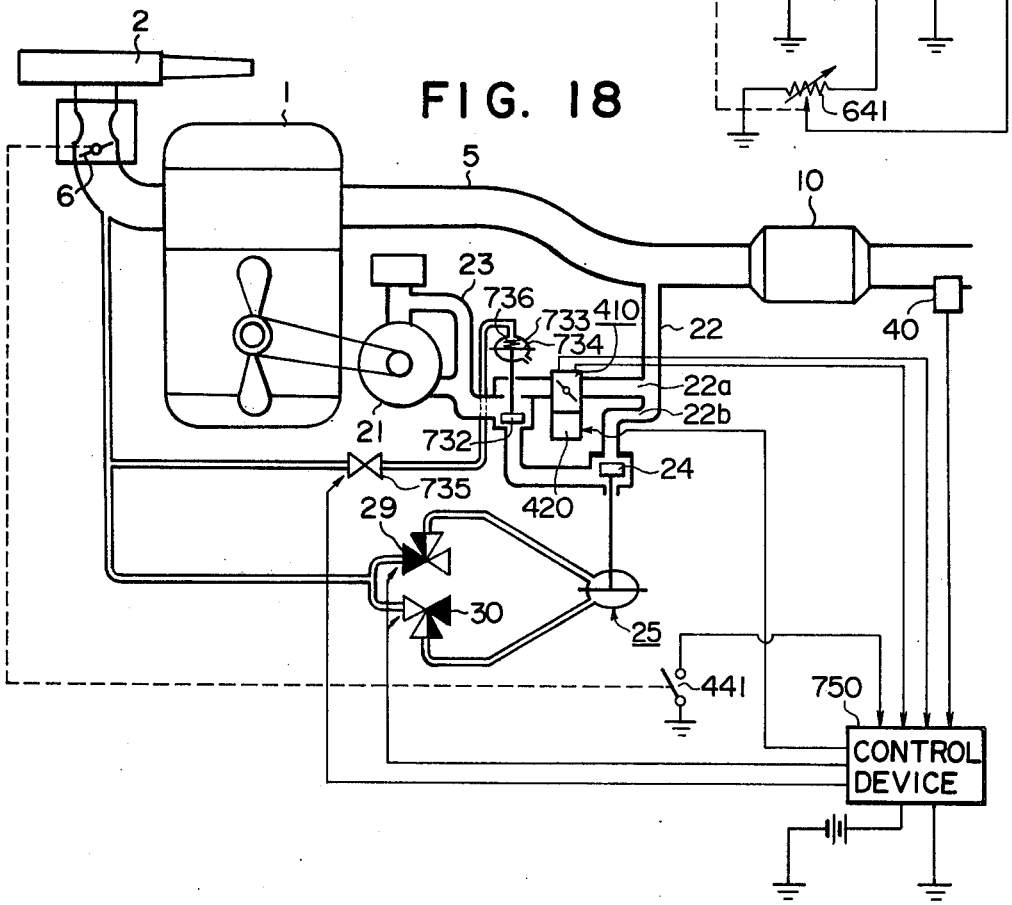
FIG. 18 is a schematic diagram showing a tenth embodiment of the apparatus of the invention.
Figure 19:
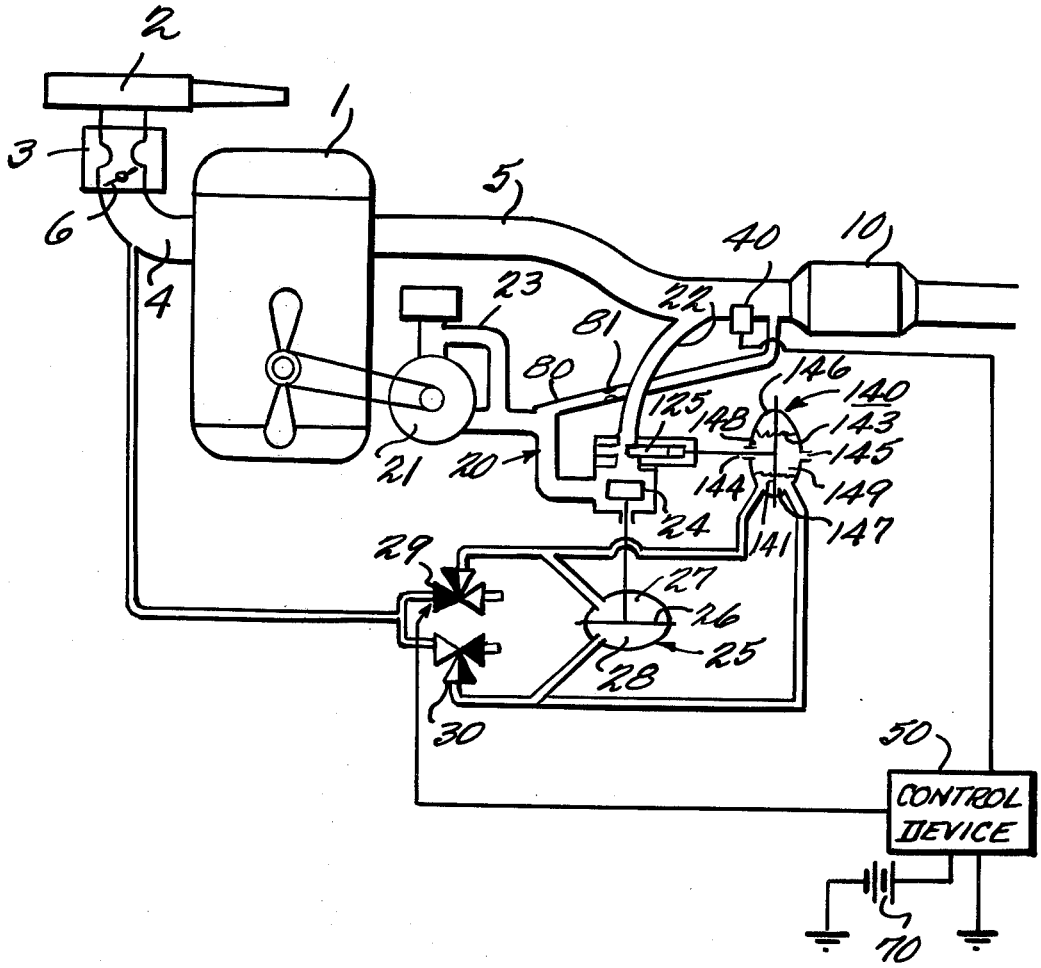
FIG. 19 is a schematic diagram showing an eleventh embodiment of the apparatus of the invention.

FIG. 18 shows a tenth embodiment of the invention. This embodiment is a modification of the eighth embodiment and a change-over valve 732 is mounted at the parting of the first and second passages 22*a* and 22*b* of the secondary air supply pipe line 22. Connected to the change-over valve 732 is a diaphragm unit 733 in which the engine intake vacuum is introduced through an electromagnetic on-off valve 735 into one of the chambers parted from each other by a diaphragm 734 and the atmospheric pressure is introduced into the other chamber. The diaphragm 734 is biased by a spring 736 in a direction which causes the change-over valve 732 to close the second passage 22*b*. A control device 750 is designed so that the pulse motor 420 is normally operated and the electromagnetic three-way valves 29 and 30 are opened and closed in accordance with the output of the air-fuel ratio sensor 40. When the throttle switch 441 is turned on, the electromagnetic on-off valve 735 is closed so that the change-over valve 732 closes the second passage 22*b*. On the contrary, when the throttle switch 441 is turned off, the electromagnetic on-off valve 735 is opened so that the change-over valve 732 is operated and the first passage 22*a* is closed. In this way, the same operation as the previously described embodiment is performed. Of course, the change-over valve of this tenth embodiment can be used in the other embodiments. FIG. 19 shows an eleventh embodiment of the invention. This embodiment is a modification of the fourth embodiment shown in FIG. 8. In this figure, similar to the embodiment of FIG. 6, the air-fuel ratio sensor 40 is disposed in the exhaust pipe 5 upstream of the exhaust gas reactor 10, and an auxiliary supply pipe line 80 is branched off from the supply pipe line 22 and opened in the exhaust pipe 5 between the sensor 40 and the reactor 10. In the embodiment the same and similar parts are given the same reference numerals in FIG. 6 or 8. The detailed description of the operation of this embodiment is omitted for the purpose of simplicity since it will be apparent from the description relative to FIGS. 6 and 8. Of course, the arrangement of the sensor and the auxiliary supply pipe line shown in FIG. 19 can be applied to the other embodiments.

What is claimed is:

1. An exhaust gas purification apparatus for an internal combustion engine comprising:

exhaust gas reactor means disposed at an intermediate portion of an exhaust pipe of an engine, for purifying exhaust gases in said exhaust pipe;

secondary air supply means having an air supply path for supplying secondary air to the exhaust gases, one end of said air supply path being opened in said exhaust pipe on the upstream side of said reactor means;

air-fuel ratio sensor means mounted in said exhaust pipe on the downstream side of said one end of said air supply path for sensing the air-fuel ratio of the exhaust gases to produce an output signal;

a control device electrically connected to said air-fuel ratio sensor means, for producing an actuation signal in accordance with the output signal of said air-fuel ratio sensor; and a first air flow control valve disposed in said air supply path for fully opening said air supply path in one condition and fully closing the same in the other condition in accordance with said actuation signal to produce pulsating air flow so that said exhaust gases in said exhaust pipe are supplied with said secondary air intermittently at a position upstream of said reactor means;

a second air flow control valve disposed in said air supply path in series with said first air flow control valve to variably control the passage area thereof; and an actuating means coupled to said second air flow control valve to actuate the same, said actuating means actuating said second control valve in accordance with the movement of said first control valve, the passage area of said air supply path being increased when the duration of opening of said first control valve is increased, and the passage area of said air supply path being decreased when the duration of closing of said first control valve is increased.

whereby the air-fuel ratio of the exahust gases to be entered into said reactor means is maintained substantially constant.

2. An apparatus according to claim 1, wherein the frequency of said pulsating air flow is approximately higher than 3 Hz.

3. An apparatus according to claim 1, wherein said actuating means is a pulse motor operable in accordance with the output signal of said air-fuel ratio sensor means.

4. An apparatus according to claim 1, wherein said actuating means includes a diaphragm displaceable in accordance with pressure difference acting thereagainst, a pair of pressure chambers defined on the opposite sides of said diaphragm, a pair of orifice chambers each having an orifice for slowing down the movement of said diaphragm, and a first and a second electromagnetic valve for controlling pressures introduced into said pressure chambers in accordance with the output signal of said air-fuel ratio sensor means.

5. An apparatus according to claim 1, wherein said actuating means is damper means comprising three bellows defining two chambers and three orifices opening said chambers to the atmosphere, wherein said second control valve is held in palce by said damper means, and wherein said damper means is operated in response to the movement of said first control valve.

6. An apparatus according to claim 1, wherein said air supply path includes at least two openings arranged along the direction of flow of the exhaust gases.

7. An apparatus according to claim 1, wherein said air-fuel ratio sensor means is located on the upstream side of said exhaust gas reactor means, and wherein an auxiliary air supply path is branched off from said air supply path and opened in said exhaust pipe between said air-fuel ratio sensor means and said exhaust gas reactor means, whereby a small amount of air is constantly supplied into said exhaust pipe through said auxiliary air supply path.

* * * * *